United States Patent [19]

Razinsky et al.

[11] Patent Number: 4,692,098

[45] Date of Patent: Sep. 8, 1987

[54] AIRFOIL FOR HIGH EFFICIENCY/HIGH LIFT FAN

[75] Inventors: Elias H. Razinsky, Toledo, Ohio; William B. Roberts, Fremont, Calif.; Richard E. Longhouse, Dayton, Ohio

[73] Assignee: General Motors Corporation, Detroit, Mich.

[21] Appl. No.: 787,503

[22] Filed: Oct. 15, 1985

Related U.S. Application Data

[63] Continuation-in-part of Ser. No. 297,874, Aug. 31, 1981, abandoned.

[51] Int. Cl.[4] ..... F04D 25/08; F04D 29/68

[52] U.S. Cl. ..... 416/223 R; 416/237; 416/DIG. 2; 416/243; 415/DIG. 1

[58] Field of Search ..... 416/223 R, 223 A, 235, 416/238, 237, 233, 233 A, 242, 243, DIG. 2; 415/DIG. 1, 191, 195

[56] References Cited

U.S. PATENT DOCUMENTS

| | | | |
|---|---|---|---|
| 1,068,946 | 7/1913 | Taylor | 416/237 |
| 1,361,277 | 12/1920 | Mott | 416/237 |
| 1,467,227 | 9/1923 | Capell | 416/237 |
| 1,933,947 | 11/1933 | Weber | 416/237 |
| 2,283,956 | 5/1942 | Smith | 416/223 |
| 2,406,499 | 8/1946 | Jandasek | 415/195 X |
| 4,329,946 | 5/1982 | Longhouse | 415/DIG. 1 X |
| 4,408,957 | 10/1983 | Kurzrock et al. | 415/181 X |

FOREIGN PATENT DOCUMENTS

| | | | |
|---|---|---|---|
| 2032048 | 4/1980 | United Kingdom | 416/237 |

OTHER PUBLICATIONS

Journal of Engineering for Power, 4–1975, pp. 261–274.

*Primary Examiner*—Robert E. Garrett
*Assistant Examiner*—Joseph M. Pitko
*Attorney, Agent, or Firm*—Charles R. White

[57] ABSTRACT

Airfoil for vehicle fan which operates in low Reynolds number and varying turbulent conditions having a discontinuity formed on the suction surface thereof adjacent to its leading edge to trigger early formation of a laminar flow bubble so that sufficient suction surface remains downstream of the air bubble whereby air circumventing the bubble can reattach to the suction surface for sufficient pressure recovery for high lift and low drag performance.

13 Claims, 8 Drawing Figures

AIRFOIL FOR HIGH EFFICIENCY/HIGH LIFT FAN

Invention is a continuation-in-part of application Ser. No. 297,874 filed Aug. 31, 1981, now abandoned.

This invention relates to fans and more particularly to new and improved high efficiency and high lift fan airfoils with predetermined suction surface discontinuity providing for induced development of a laminar separation bubble at a predetermined forward point on such surface so that separated air flowing over the bubble can reattach to the suction surface for establishment of substantial pressure recovery.

Automotive engine cooling air fans generally operate in a range of low Reynolds numbers and a wide range of turbulence levels and encounter excessive separation of laminar boundary air flowing across their suction surfaces. This detracts from fan efficiency and air pumping capability. To provide for improved fan operation, classical fan airfoils such as NACA-65 have been employed. However, such fan blade designs have been unable to supply the higher lift to drag ratios now desired for surface vehicle applications. In such classical airfoil construction boundary air flows across a laminar boundary layer region of the suction surface of the airfoil and a laminar flow separation bubble naturally occurs. This bubble has varying length, which increases as the Reynolds number decreases and/or turbulence level of upstream air decreases. The laminar flow separation bubble can accordingly grow from its origin to extend across a large part of the remaining suction surface so that the air flow circumventing the bubble cannot readily reattach to the suction surface to provide for the high lift and efficiency needed to meet higher standards for vehicle engine cooling fan operation.

To obtain high lift and low drag, flow reattachment and pressure recovery is needed in the shortest possible distance after the flow separation bubble. To this end, this invention tailors an airfoil for the establishment of a mechanically induced bubble at a predescribed forward point on the suction surface. This point is before the transition from laminar to turbulent flow and is accordingly in the laminar boundary flow region and ahead of the starting point of a naturally occurring laminar flow separation bubble. With the positioning of the bubble in a forward location in a laminar boundary flow region and with a smooth Stratford pressure recovery region downstream of the bubble, a large pressure recovery area is provided so that there is reattachment of boundary air to such surface and such reattached flow extends across the recovery surface. Generally, with this invention, separated flow is quickly blended and reattached to the airfoil at optimum points on the Stratford pressure recovery region of the suction surface at the end of the bubble to provide for high lift and low drag.

In the development of one embodiment of this invention, a mathematical model of a section of the blade surface was made with prescribed velocity or pressure distribution which would give the highest lift and lowest drag. The model was designed to recognize the existence of a laminar separation bubble and to require separation of laminar boundary flow at a predetermined upstream or forward position on the suction surface thereof. At predetermined pressure points on this surface, pressure recovery was required so that flow downstream of the bubble blended and reattached to a large area of the Stratford pressure recovery region of the suction surface. Accordingly, to maximize lift and minimize drag, the suction surface of the mathematical model was designed to obtain a velocity distribution recovery a given pressure difference in the shortest distance without turbulent flow separation. The blade shape corresponding to the optimized prescribed velocity distributions was then calculated from the model.

In a preferred embodiment of this airfoil, a surface discontinuity, such as a flat, step, scribe mark, cavity, surface roughness, can be made on the suction surface thereof to precisely establish the points of origin of the induced laminar separation bubble in the laminar boundary layer region of the suction surface and well ahead of the points of origin of a naturally occurring separation bubble. In one preferred design, a flat was added to the suction surface in the laminar boundary layer region of the calculated blade shape to provide the discontinuity to thereby originate the induced laminar separation bubble at a precise location and to accommodate part or all of reattachment of the separated flow upstream of the pressure recovery region. This airfoil design procedure therefore dictates the separation point through the discontinuity location and provides for the flat geometry in predicting the reattachment points of the separated flow.

In this preferred embodiment, the flat forms a ramp that makes a 9° angle with a tangent to the upstream suction surface of the blade to efficiently pump under low Reynolds number flow conditions or under a wide range of turbulence levels. Early establishment of the start of the bubble provide a control to prevent catastrophic failure (no reattachment of separated flow) so that the design is suitable for the entire range of engine fan cooling operation including idle.

A feature, object and advantage of this invention is to provide a new and improved fan airfoil section with a suction surface designed to mechanically induce the development of a laminar separation bubble at a predetermined forward point on a laminar boundary air flow region and in a forward point on such surface so that separated boundary air flowing over the bubble can subsequently reattach to the suction surface for establishment of substantial pressure recovery.

Another feature, object and advantage of this invention is to provide a new and improved airfoil for a vehicle fan having a suction surface discontinuity formed in the laminar boundary layer region thereon to trigger development of a separation bubble at a predetermined forward point thereon allowing detached boundary air sufficient area on the suction surface to reattach for pressure recovery for high lift and low drag.

Another feature, object and advantage of this invention is to provide a new and improved airfoil section for vehicle fan blading in which a laminar separation bubble developed on the suction side of the airfoil is forced to occur in an upstream or forward portion of the airfoil section and ahead of points at which a laminar flow separation bubble naturally occurs so that there is sufficient space on the suction surface for reattachment of separated air to provide for high lift and low drag operation for improved fan efficiency.

Another feature, object and advantage of this invention is to provide a new and improved airfoil for a vehicle fan in which a surface discontinuity is formed on a predetermined portion of the upstream suction surface so that a laminar flow separation bubble starts in a laminar boundary layer region at the same place regardless of low Reynolds number and low turbulence conditions of flow to thereby enable flow reattachment to the suction surface downstream of the bubble for high lift and efficiency.

A feature and object of this invention is to provide a method of improving air pumping efficiency of a fan having a plurality of blades each having a pressure surface and a suction surface leading rearwardly from a forward and radially extending nose portion to a terminal and radially extending edge portion defining an airfoil. The method incorporates the steps of establishing a surface discontinuity at points on said suction surface closely adjacent said radially extending nose portion and in a region upstream of a zone of boundary air transiting from laminar to turbulent boundary air. The laminar boundary air flowing across said suction surface is tripped with said discontinuity to establish a laminar flow separation bubble. With early tripping, the bubble terminates well upstream of the terminal radial edge of the blade s that laminar boundary air flowing onto said suction surface will become detached approxiamte to said discontinuity and flow over said bubble and quickly back onto said suction surface downstream of said bubble in a pressure recovery region of said suction surface thereby providing improved lift and reduced drag of said blades.

These and other features, objects and advantages of this invention will be more apparent from the following detailed description and drawing in which.

Figure 1:
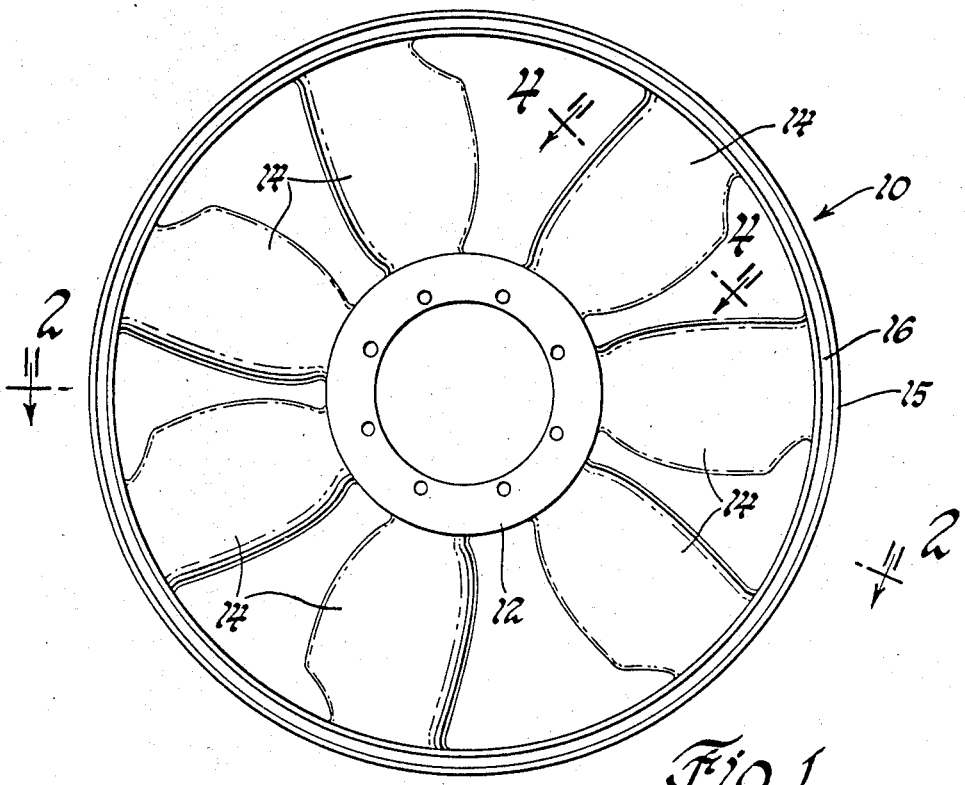
FIG. 1 is a front elevational view of a multibladed fan for land vehicle use incorporating this invention.
Figure 2:
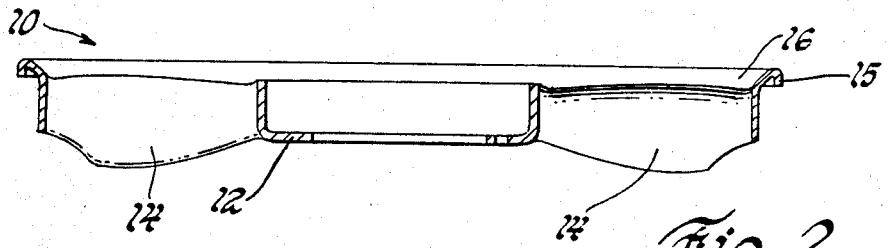
FIG. 2 is a cross sectional view of the fan of FIG. 1 taken along lines 2—2 thereof.

Turning now in greater detail to the drawing, there is shown in FIGS. 1 and 2 a multibladed fan assembly 10 designed for use for a land vehicle and particularly for inducing air flow through a radiator for engine cooling purposes. The fan has a hub 12, a plurality of blades 14 extending generally radially from hub 12 and has an outer ring-like shroud 15 with an annular bell-mouthed inlet section 16 to provide for smooth recirculation flow into the fan blading such as disclosed in U.S. Pat. No. 4,329,946 issued May 18, 1982 to Richard E. Longhouse and assigned to the assignee of this invention and hereby incorporated by reference.

Figure 3:
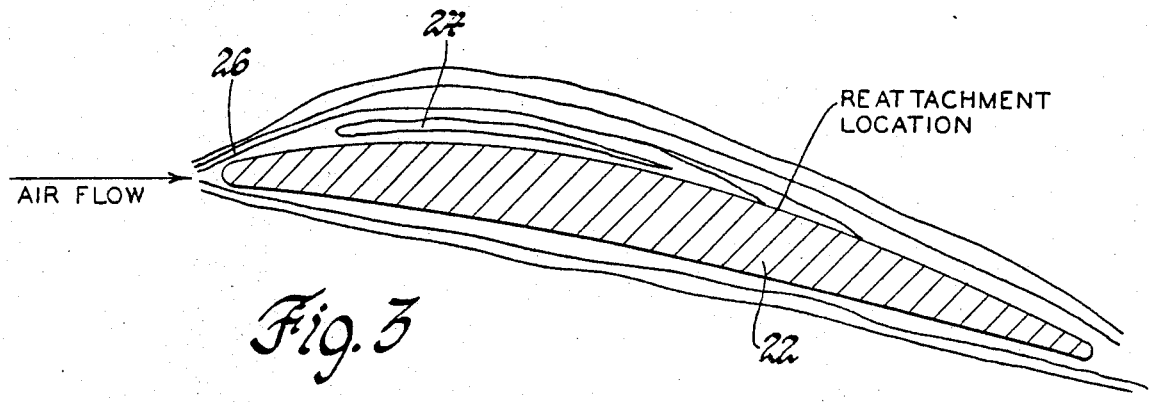
FIG. 3 is a sectional view of a classical airfoil configuration.

To improve fan efficiency, airfoils 22 with classical profiles such as the profile of the NACA-65 series illustrated in FIG. 3 have been employed in engine cooling fans. Such airfoils develop laminar separation bubbles 24 which start at a plurality of locations at the end of the laminar boundary layer region and which grow depending on flow conditions such as dictated fan speed. These bubbles cause separation of boundary air flowing across the suction side of the airfoil. This separation may begin at point 26, for example, immediately before the separation bubble. After flow separation or detachment, the air flows over the bubble and usually becomes reattached to the suction surface of the airfoil at some point downstream of the bubble. At low Reynolds number operation, such as during low relative speed due to engine design constraints or engine idle, the laminar separation bubble grows to a point where there is limited surface remaining for reattachment. When this occurs, pressure recovery is reduced so that lift is materially reduced and drag is increased. Under extreme conditions which may be termed "bubble busting", the bubble extends across the pressure recovery area of the airfoil so that reattachment cannot occur and there is substantial performance failure of the airfoil.

Figure 4:
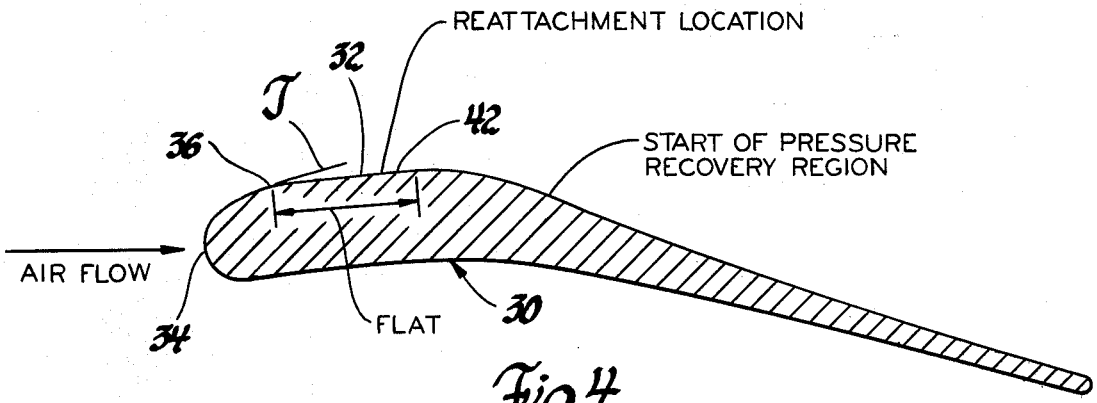
FIG. 4 is a sectional view of one of the airfoils used on the fan of FIG. 1 and taken along lines 4—4 of FIG. 1.

To provide for improved pressure recovery, a new and improved airfoil 30 shown in FIG. 4 is provided by this invention. In this design, a discontinuity in the form of a sharp edged flat or ramp 32 transverse to the cord of the airfoil and adjacent to the airfoil nose 34 is provided. The flat 32 extends rearwardly from a forward sharp edge 36 that is located forwardly in the laminar boundary layer region R illustrated in FIG. 4. The fan is inclined at a predetermined angle with respect to a line T, tangent to the upstream blade surface. This flat extends rearwardly from the sharp edge 36 and smoothly blends into the suction surface of the blade prior to the pressure recovery profile so that there is only one discontinuity and only a single laminar flow separation bubble develops.

Figure 5:
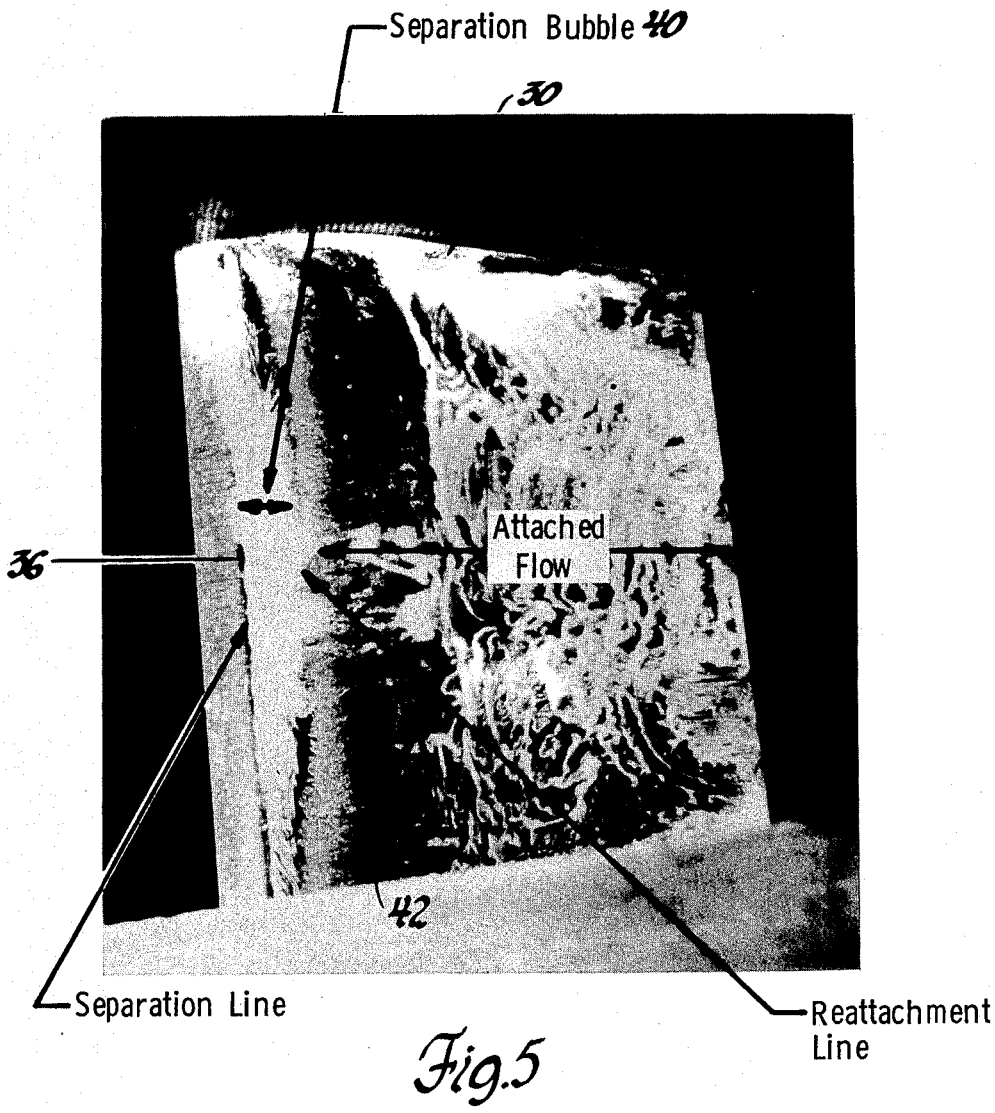
FIG. 5 is a perspective view of the airfoil of FIG. 4 illustrating detachment and reattachment of air flow across the suction surface thereof.

Accordingly, with this invention a single laminar separation bubble will develop which has a predetermined starting point as dictated by the discontinuity, i.e., the sharp edge 36 off flat 32, and which extends rearwardly along the ramp. At a particular point along the ramp the bubble will terminate so that the air flowing around the bubble will reattach on the suction side of the blade. This action is illustrated in FIG. 5 which is an airfoil section made with a flat in accordance with this invention and painted with a mixture of titanium dioxide and oil. This airfoil section was placed in a wind tunnel and the flow visualization photograph, FIG. 5, was made while the section experienced low Reynolds number flow. The separation bubble 40 was triggered by the sharp edge 36 of the flat during tests in a range low Reynolds numbers and varying turbulence intensity conditions including low turbulence operation. This bubble terminates on the flat 32 and the air flowing around and over the bubble reattaches on the flat and along the Stratford pressure recovery region on the suction surface 42 immediately behind the bubble to provide for improved airfoil operation for high lift and reduced drag. The turbulence shown in FIG. 5 represent turbulent boundary layer reattached to the suction surface. In this invention there is no separation once the turbulent boundary layer is formed.

Figure 6:
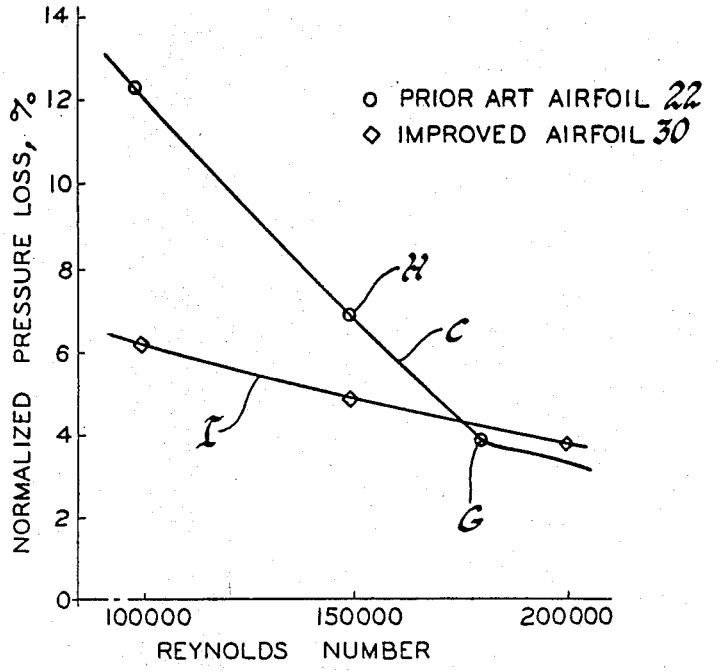
FIG. 6 is a graph comparing operating characteristics of the airfoils of FIGS. 3 and 4.

FIG. 6 contains curves C and I respectively comparing pressure loss incurred by classical airfoil 22 and the airfoil 30 of this invention for Reynolds numbers decreasing from 200,000 to 100,000. At point G, the laminar bubble in the classical airfoil starts growing extending into the pressure recovery region of the airfoil. Pressure loss subsequently increases to a point H, for example, in which there is failure to provide appreciable lift and drag is high. In contrast, the laminar separation bubble in the blade configuration of this invention illustrated by curve I, is controlled by its predetermined downstream location and the pressure loss is stabilized so that there is high lift and low drag throughout the illustrated Reynolds number operating range.

Figure 7A:
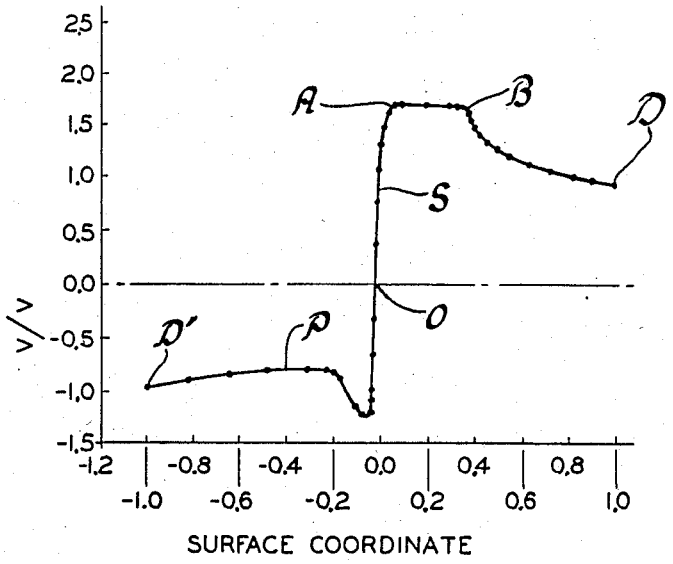
FIGS. 7A and 7B are plots illustrating the development of the airfoil of FIG. 4.
Figure 7B:
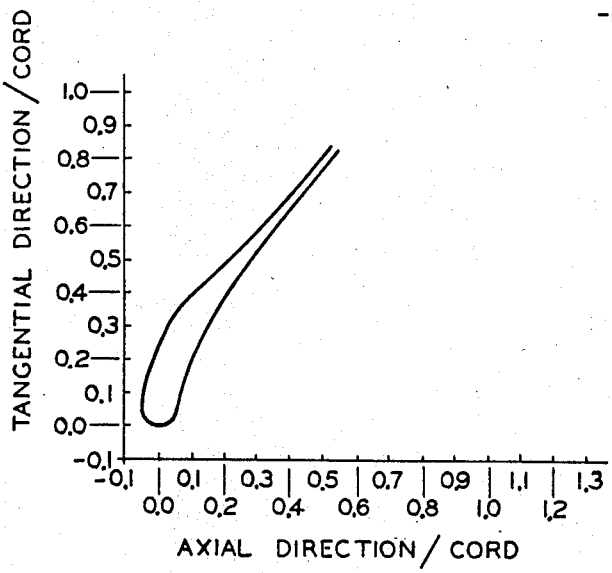

FIGS. 7A and 7B illustrate the development of the preferred embodiment of the present invention. The curve of FIG. 7A represents the mathematical model of blade surface of velocity distribution which gives the highest lift and lowest drag. At point A on the suction surface curve S, there is forced separation as close to the origin of the suction surface as practical. The segment A-B of this curve represents the start of flow separation to the recovery region. The curve from point B to point D, the trailing edge of the blade, represents the shape of the velocity curve to produce pressure recovery in the shortest practical distance. The pressure curve P extending from the origin 0 to point D', the trailing edge of the pressure surface, was devised to provide for a practical blade design in terms of blade thickness including thickness of the trailing edge. This surface is also designed to control the amount of turning of air flow into the blade and, in conjunction with the suction surface, provides for the high lift and low drag. If curve P is rotated counterclockwise 180°, the area formed between curves S and P represent the maximized high lift obtained. Using the surface coordinate points from the mathematical model, the airfoil section illustrated in FIG. 7B is plotted to which the discontinuity is subsequently added to form the shape of the airfoil of FIG. 4. The location of the flat is determined from the specification of the velocity distribution coordinates of the mathematical model and the discontinuity point corresponding to the peak velocity location.

While a preferred embodiment of the invention has been shown and described, other modifications will become apparent to those skilled in the art. Accordingly, the scope of this invention is set forth in the following claims.

The embodiments of the invention in which an exclusive property or privilege is claimed are defined as follows:

1. An airfoil defining the shape of the blades of an engine cooling fan of a land vehicle which optimally operates in a range of low Reynolds numbers and varying turbulence intensity conditions, said airfoil having a suction surface and a pressure extending from a leading edge to a trailing edge thereof, said suction surface being curved and having triggering means formed thereon closely adjacent to the leading edge of said airfoil to trigger establishment of a discrete laminar air flow separation bubble with a terminal end upstream of said trailing edge of said airfoil which effects the separation of laminar boundary air flowing onto said suction surface of said airfoil at a substantially constant and predetermined point forward of said bubble when operating in said range of low Reynolds numbers and varying turbulence intensity conditions and which provides for the reattachment of air circumventing said laminar separation bubble on said suction surface subsequent to passage over said bubble to thereby provide for high lift and low drag for high efficiency fan performance.

2. An airfoil defining the shape of the blades of an engine cooling fan of a land vehicle fan which optimally operates in a range of low Reynolds numbers and varying turbulence intensity conditions, said air foil having a suction surface and a pressure surface extending from a leading edge to a trailing edge thereof, said suction surface being curved and having a discrete surface discontinuity means formed in a laminar flow region thereof closely adjacent to the leading edge of said airfoil to trigger establishment of a laminar air flow separation bubble substantially starting at said discontinuity and extending rearwardly therefrom to a discrete terminal end before said trailing edge of said airfoil which effects the separation of laminar air flowing into said airfoil at a predetermined point forward of said bubble, said suction surface being smooth and continuous downstream of said discontinuity to the trailing edge of said airfoil to provide for the reattachment of air circumventing said laminar separation bubble on said suction surface subsequent to passage over said bubble to thereby provide for high lift and low drag for high efficiency fan performance.

3. An airfoil defining the shape of the blades of an engine cooling fan of a land vehicle which efficiently operates in a range of low Reynolds numbers and varying turbulence intensity conditions, said airfoil having a curved suction surface and a pressure surface extending from a leading edge to a trailing edge thereof, said airfoil having a sharp edged and elongated discontinuity formed in a laminar flow region on said suction surface closely adjacent to the leading edge of said airfoil and transverse to the chord thereof to trigger establishment of a laminar air flow separation bubble above said suction surface starting consistently at a predetermined point adjacent to said leading edge which extends rearwardly from said discontinuity to a discrete terminal end upstream of said trailing edge to effect the separation of laminar boundary air flowing onto the suction surface of said airfoil at a predetermined point forward of said bubble, said suction surface being smooth and uninterrupted from said discontinuity to said trailing edge to thereby provide for the reattachment of air circumventing said laminar separation bubble on said suction surface subsequent to passage over said bubble for high lift and low drag airfoil operation.

4. In a vehicle fan circulating air for engine cooling, said fan having a centralized hub and a plurality of airfoils extending generally radially from said hub to terminal points, each of said airfoils having a pressure surface on the lower side thereof and a curved suction surface on the upper side thereof, a sharp edge discontinuity formed by a flat on each of said suction surfaces transverse to the chord of said airfoil and in a laminar flow region closely adjacent to the leading edge thereof, said discontinuity being operative to effect the establishment of a laminar air flow separation bubble for a range of Reynolds numbers consistently starting at a predetermined location on said suction surface substantially at said discontinuity and closely adjacent to the leading edge of said airfoil, a flat rearwardly of said discontinuity allowing detached air flowing across said suction surface and circumventing said bubble to reattach to said flat of said suction surface downstream of said bubble to provide for high lift and low drag.

5. An airfoil for a land vehicle engine cooling fan which operates in a low Reynolds number range and a varying turbulence intensity conditions, said airfoil having a continuously smooth curved suction surface on one side thereof and a curved pressure surface on the other side thereof, said airfoil having a leading edge and a trailing edge, said suction surface having a sharp edged discontinuity formed in said curved suction surface thereof in a laminar flow region of said airfoil and closely adjacent to the leading edge to consistently establish the start of a laminar separation bubble at a predetermined forward location on said suction surface for said range of low Reynolds numbers and a flat downstream of said discontinuity whereby laminar boundary flow entering onto the airfoil becomes detached at a predetermined point forward of said separation bubble and becomes reattached after flow around said bubble at a pressure recovery location downstream of said bubble and on said flat to provide for high lift and low drag for high efficiency fan operation.

6. In a vehicle fan for circulating air for engine cooling, said fan having a centralized hub and a plurality of arcuately-spaced airfoils extending generally radially from said hub and terminating in tip portions, an annular bell-mouthed shroud attached to said tip portions for directing laminar flow recirculating air into said airfoils, each of said airfoils having a pressure surface and a suction surface, a discontinuity on said suction surface having an elongated sharp forward edge closely adjacent the leading edge thereof in a laminar flow region of said suction surface to effect establishment of a laminar separation bubble starting at a predetermined location on said suction surface and a flat blade contour extending downstream from said discontinuity and smoothly blending into said suction surface whereby boundary air flowing into said airfoil becomes initially detached from said suction surface for circumventing said bubble and subsequently for reattachment to said suction suface on said flat for optimized pressure recovery to provide for high lift and low drag.

7. A method of improving the air pumping efficiency of a fan having a plurality of blades radiating from a centralized hub to terminal tip portions, each of said blades having a pressure surface and a suction surface leading rearwardly from a forward and radially extending nose portion to a terminal and radially extending edge portion defining an airfoil comprising the steps of designing a mathematical model of a cross section of said airfoil which provides optimized lift and reduced drag and which recognizes the existence of a laminar flow separation bubble and establishes the point of separation of laminar boundary air flowing across said suction surface and said bubble, plotting a section of said airfoil from said mathematical model to provide the shape thereof, establishing a surface discontinuity along a line on said suction surface of said airfoil which corresponds to said point of separation and in a region upstream of a zone on said suction surface in which boundary air naturally transits from a laminar to turbulent flow, tripping the laminar boundary air flowing across said suction surface with said discontinuity to physically establish a laminar flow separation bubble that terminates upstream of said terminal radial edge portion so that laminar boundary air flowing onto said suction surface will become detached adjacent to said discontinuity and flow over said bubble and back onto said suction surface downstream of said bubble in a pressure recovery region of said suction surface thereby providing inproved lift and reduced drag of said blades.

8. An airfoil for a land vehicle fan which operates in a range of low Reynolds numbers and varying turbulence intensity conditions, said airfoil having a suction surface and a pressure surface extending from a leading edge to a trailing edge thereof, said suction surface being curved and having a discrete surface discontinuity formed therein starting at a predetermined point closely adjacent to the leading edge of said airfoil to trigger establishment of a laminar flow separation bubble which substantially starts at said predetermined point and extends rearwardly therefrom to a discrete terminal end before said trailing edge of said airfoil to effect the consistent separation of laminar air flowing onto said suction surface adjacent to said predetermined point and forward of said bubble, said suction surface being smooth and continuous downstream of said discontinuity to the trailing edge of said airfoil to provide a surface enhancing reattachment of separated air circumventing said laminar separation bubble subsequent to passage over said bubble to thereby provide for high lift and low drag for high efficiency fan performance.

9. An airfoil for a land vehicle engine cooling fan which efficiently operates in a range of low Reynolds numbers and varying turbulence intensity conditions, said airfoil having a curved suction surface and a pressure surface extending from a leading edge to a trailing edge thereof, said airfoil having a discontinuity with a sharp forward edge formed on said suction surface closely adjacent to the leading edge of said airfoil and transverse to the chord thereof to trigger establishment of a laminar flow separation bubble adjacent to said sharp forward edge for a wide range of Reynolds numbers and turbulence intensity conditions and which extends rearwardly to a discrete terminal end on said suction surface downstream of said sharp forward edge, said bubble being operative to effect the separation of laminar boundary air flowing on the suction surface of said airfoil at a substantially constant and predetermined point forward of said bubble, said suction surface being smooth and uninterrupted from said sharp forward edge of said discontinuity to said trailing edge to thereby provide for the reattachment of air circumventing said laminar flow separation bubble on said suction surface subsequent to passage over said bubble for high lift and low drag airfoil operation.

10. In a vehicle fan for circulating air for engine cooling, said fan having a centralized hub and a plurality of airfoils extending generally radially from said hub and terminating in tip portions, each of said airfoils having a pressure surface and a suction surface, said suction surface being curved, a discontinuity in the form of a flat transverse to the chord of said airfoil, said flat having a sharp forward edge on said suction surface closely adjacent the leading edge of said airfoil to effect establishment of a discrete laminar flow separation bubble starting at a predetermined location on said suction surface adjacent to said forward edge and terminating prior to the trailing edge of said airfoil, said flat extending rearwardly from said sharp edge into a smooth blend with said suction surface whereby a laminar boundary layer of air becomes initially detached from said suction surface consistently at the start of said bubble and flows over said bubble and subsequently becomes reattached in a pressure recovery region on said suction surface to produce high lift and low drag.

11. In a vehicle fan for circulating air for engine cooling, said fan having a centralized hub and a plurality of airfoils extending generally radially from said hub to terminal pounts, each of said airfoils having a pressure surface on the lower side thereof and a curved suction surface on the upper side thereof, a discontinuity having a forward edge on said suction surface transverse to the chord of said airfoil and closely adjacent to the leading edge thereof to induce establishment of a laminar air flow separation bubble constantly starting at a predetermined location on said suction surface substantially at said forward edge of said discontinuity and closely adjacent to the leading edge of said airfoil, said bubble terminating without bursting and before the trailing edge of said airfoil, a flat rearwardly of said forward edge allowing detached boundary air flowing across said suction surface and circumventing said bubble to reattach to said flat of said suction surface downstream of said bubble to provide for high lift and low drag.

12. An airfoil for a land vehicle engine cooling fan which operates in a range of low Reynolds numbers and varying turbulence intensity conditions, said airfoil having a continuously smooth curved suction surface on one side thereof and a curved pressure surface on the other side thereof, said airfoil having a leading edge and a trailing edge, said suction surface having a sharp edged discontinuity formed in said curved surface thereof closely adjacent to the leading edge of said airfoil to establish the start of a laminar separation bubble at a predetermined forward location on said suction surface and a flat downstream of said discontinuity whereby laminar flow bounding said airfoil becomes detached at a predetermined point on said suction surface and forward of said separation bubble and becomes reattached after flow around said bubble in a pressure recovery location downstream of said bubble and on said flat to provide for high lift and low drag for high efficiency fan operation.

13. In a vehicle fan for circulating air for engine cooling, said fan having a centralized hub and a plurality of arcuately-spaced airfoils extending generally radially from said hub and terminating in tip portions, an annular bell-mouthed shroud attached to said tip portions for directing laminar flow recirculating air into said airfoils, each of said airfoils having a pressure surface and a suction surface, a discontinuity on said suction surface having an elongated sharp forward edge closely adjacent the leading edge thereof to effect establishment of a laminar flow separation bubble starting at a predetermined location on said suction surface and a flat extending downstream from said sharp forward edge and smoothly blending into said suction surface whereby laminar air flowing into said airfoil becomes initially and consistently detached from said suction surface near said sharp forward edge and circumvents said bubble and subsequently becomes reattached to said suction surface on said flat for optimized pressure recovery to provide for high lift and low drag.

* * * * *